United States Patent [19]

Handschuch et al.

[11] Patent Number: 4,697,409

[45] Date of Patent: Oct. 6, 1987

[54] OPEN-END SPINNING DEVICE

[75] Inventors: Karl Handschuch, Gaimersheim; Erich Bock, Wettstetten, both of Fed. Rep. of Germany

[73] Assignee: Schubert & Salzer, Ingolstadt, Fed. Rep. of Germany

[21] Appl. No.: 878,977

[22] PCT Filed: Nov. 11, 1985

[86] PCT No.: PCT/DE85/00448

§ 371 Date: Jun. 30, 1986

§ 102(e) Date: Jun. 30, 1986

[87] PCT Pub. No.: WO86/02956

PCT Pub. Date: May 22, 1986

[30] Foreign Application Priority Data

Nov. 13, 1984 [DE] Fed. Rep. of Germany ..... 3441494

[51] Int. Cl.[4] ..... D01H 7/892; D01H 7/895

[52] U.S. Cl. ..... 57/401; 57/408

[58] Field of Search ..... 57/400, 401, 408–413, 57/90

[56] References Cited

FOREIGN PATENT DOCUMENTS 361814 5/1978 Fed. Rep. of Germany ..... 57/401

2720625 11/1979 Fed. Rep. of Germany ..... 57/401

367104 2/1981 Fed. Rep. of Germany ..... 57/401

*Primary Examiner*—Donald Watkins

*Attorney, Agent, or Firm*—Dority & Manning

[57] ABSTRACT

The invention concerns an open-end spinning device with a release mechanism and two friction rollers in close proximity of each other, said friction rollers being driven in the same direction, wherein fibers are twisted together into a thread within the notch zone formed by said friction rollers, and furthermore concerns a thread draw-off device. According to the invention, the fibers are fed into the notch via a collecting surface moving parallel to the thread forming line. The collecting surface is located on the periphery of a disk-like cylinder, the rotational axis of said cylinder being located in a plane perpendicular to the notch. In a variant, the collecting surface is located on the surface of a disk or within a rotor in the form of an inner cone.

28 Claims, 7 Drawing Figures

OPEN-END SPINNING DEVICE

BACKGROUND AND SUMMARY OF THE INVENTION

The invention concerns and open-end spinning device with an unravelling device and two friction rollers in close proximity to each other and capable of being driven in the same direction, whereby the fibers are twisted together into a thread in the notch zone formed by said friction rollers, and furthermore concerns a thread draw-off mechanism.

In a known open-end spinning machine of the type mentioned intitially, the fiber material is unravelled into single fibers which are brought directly into the notch zone between two parallel suction drums of equal size and parallel to each other, set in close proximity to each other (DE-PS No. 2,449,583). The two suction drums rotate in the same direction and the individual fibers are fed into the notch as they fly through the air, reaching the suction zone of said suction drums in a stream that is approximately perpendicular to the plane of the axes of the two drums. The rotation of the suction drums twists the fibers together and these are then drawn off in form of a thread, in a line parallel to the drums, by a pair of draw-off drums.

However, the approximately perpendicular feeding of the fibers into the notch zone results in unsatisfactory yarn parameters, in particular with finer yarns, since the fibers are not attached regularly to the free, rotating yarn end and do not lie evenly within the yarn. Measures have therefore been proposed in the past to bring the fibers into a nearly parallel position with respect to the yarn axis when they are fed into the notch, such as by mechanical means for example, as with a whirling disk (DE-PS No. 2,720,625) or by pneumatic means such as cascade-like grading of the air pressure in the path of the fibers (DE-OS No. 2,732,678) or by feeding the fibers along a path which is inclined with respect to the thread draw-off direction, in combination with an airstream flowing essentially parallel to the thread axis. However, yarn parameters are not satisfactory in spite of these measures, especially at higher spinning speeds.

It is the object of the instant invention to create a device making it possible to control the fibers and to feed them into the notch in a parallel position, and to thereby improve the structure and solidity of the yarn.

The instant invention attains this objective with a device according to the introductory clause of claim 1, by means of a collecting surface moving parallel to the thread forming line, whereby the fibers are being fed into the notch zone over said collecting surface.

In a preferred embodiment the collecting surface is located on the periphery of a disk-like cylinder, the rotational axis of said cylinder being in a plane which is perpendicular to the notch. The peripheral speed of the collecting surface is approximately equal to the thread draw-off speed, thus making it possible to collect the full mass of fibers needed for the finished thread on the collecting surface, so that doubling of the fibers results.

A delay, together with a resulting further parallel orientation of the fibers in the notch, as well as the doubling of the fibers on the collecting surface which is increased by this delay, is obtained by giving the peripheral movement of the collecting surface a lower speed than the speed of the thread being drawn off. In order to obtain a stretching of the fibers, the peripheral speed of the collecting surface is at least equal to the feeding speed of the fibers.

Doubling therefore no longer takes place as when the fibers are fed into the gusset by means of a fiber feeding channel in the zone of rotation, but in a rotation-free zone. By thus separating rotation and doubling, a yarn of higher quality is produced.

In order to lay the arriving fibers upon the collecting surface within a precisely defined zone, the collecting surface is grooved. The width of the groove is approximately equal to the thickness of the arriving fiber material, so that a fiber formation is created which closely corresponds to the diameter of the yarn. A groove with a V-shaped cross-section is an efficient one. The fibers are held on the collecting surface by needles. Preferrably, and possibly in addition to the needles, the fibers are held on the collecting suface by pneumatic means. The division of the collecting surface into different sectors has the advantage of creating conditions to hold the fibers during conveying and for transfer into the notch zone.

The loosening of the fibers from the collecting surface in the notch zone is assisted and accelerated by an airstream flowing through the collecting surface in the area of transfer, conveying the fibers from said collecting surface into the notch zone. The airstream is produced by opening the transfer sector of the collecting surface to the atmosphere. Should this prove to be insufficient, overpressure can be brought to bear upon the transfer sector of the collecting surface. In order to maintain a defined air current within the collecting surface area, said collecting surface is enclosed within a housing.

A known unravelling device is connected before the collecting surface to ensure separation and feeding of the fiber material upon said collecting surface. The unravelling device is connected to the collecting surface through a fiber channel which is disposed essentially at a tangent to the direction of the collecting surface's movement. The outlet of the collecting surface is adapted to the width of the collecting surface.

Even greater precision in the feeding of the fibers onto the collecting surface in the direction of said collecting surface's movement is achieved if the fiber feeding channel is omitted. This is made possible by locating the housing of the unravelling roller directly next to the housing of the cylinder, the two housings being connected with each other through a connection opening which they have in common. It is practical to add a cleaning device to the collecting surface, between the point of fiber transfer into the notch area and the feeding point. Adjustability of the distance between collecting surface and thread formation line, depending upon the length of the fibers being spun together, makes it possible to adapt the device to different spinning conditions.

BRIEF DESCRIPTION OF THE DRAWINGS

Different embodiments of the invention are described by means of the following drawings.

DESCRIPTION OF THE PREFERRED EMBODIMENT

Figure 2:
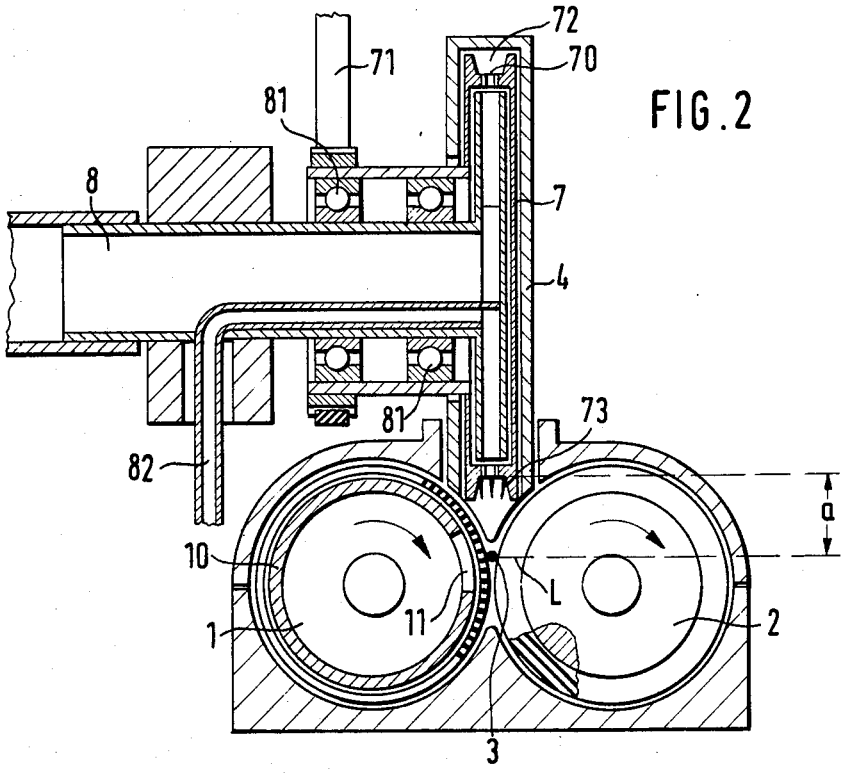
FIG. 2 shows a side view of the device of FIG. 1.
Figure 1:
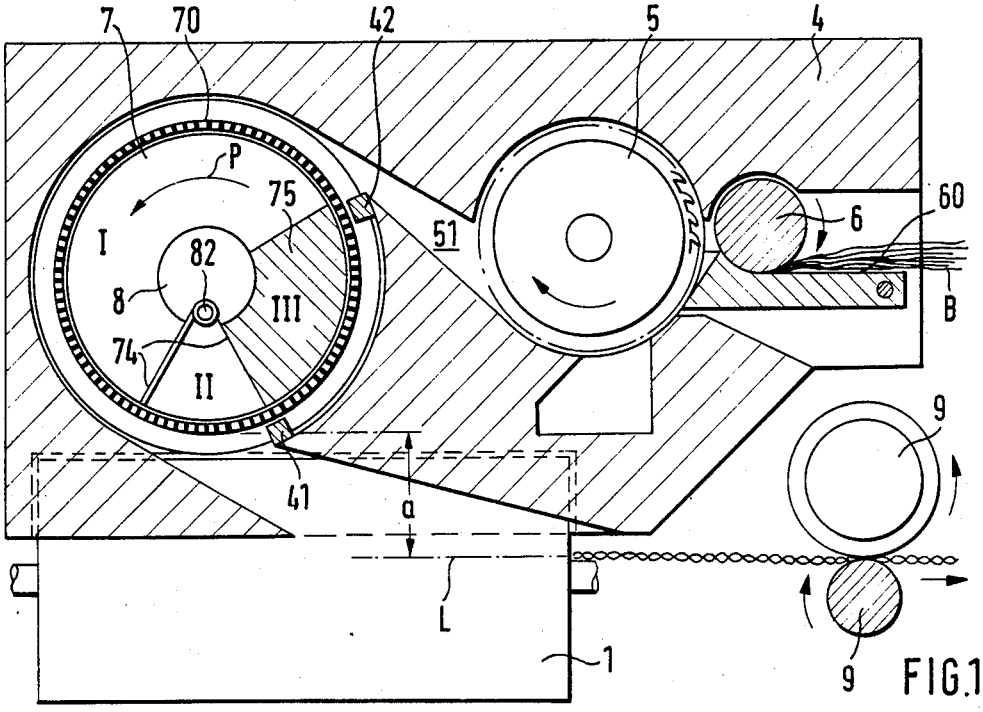
FIG. 1 shows a cross-section of the spinning device according to invention.

FIG. 1 shows one of the friction rollers 1 and 2 which, as can be seen in FIG. 2, are in close proximity and parallel to each other. The friction rollers 1 and 2 form a notch 3 in which the arriving fibers are spun into a yarn. Friction rollers 1 and 2 are driven in the same direction in a manner not shown in detail here, such as for example by means of a tangential belt. The friction roller 2, rotating away from the spinning notch 3, is not perforated and not subjected to suction air. The roller 1, rotating toward the notch 3, has a perforated casing surface and is equipped with a suction device (not shown) connected to a suction element 10 (FIG. 2). The suction inset 10 is provided with a slit in the notch zone, in the longitudinal sense of said notch zone (3), and a suction air stream is produced through said slit. The design of the friction rollers has no bearing upon the instant invention. It is also possible to subject both friction rollers to suction force.

The fiber material to be spun is unravelled into single fibers by means of an unraveling device located within housing, said unravelling device consisting of an unravelling roller 5, equipped with a garniture, which is preceded by a connected feeding roller 6 functioning in combination with a feeding trough 60.

Between the unravelling roller 5 and the friction rollers 1 and 2, a disk-like cylinder 7, enclosed in a housing 4, is rotatably suspended on bearings and is provided with a collecting surface 70 on its periphery. Collecting surface 70 is connected to the unravelling device 5 through a fiber channel 51 which runs approximately at a tangent to the direction of rotation of the collecting surface 70 and opens upon said collecting surface, the width of said channel being adapted to the width of said collecting surface 70.

Cylinder 7 is suspended by means of roller bearings 8 on a hollow shaft 8 extending in a plane perpendicular to the spinning notch 3, said cylinder 7 being driven in direction of arrow P by means of a toothed belt 71. Cylinder 7, moving at the spinning notch in a direction which is parallel to the thread forming line L, is made to extend as far as possible into the notch area, so that the path of the fibers from collecting surface 70 to thread forming line L can be kept as short as possible. Thus the fibers are controlled as they are fed into the spinning notch 3. The distance between the collecting surface 70 and the thread forming line L should however be sufficiently great to allow for the fibers to move freely into the spinning notch 3, thus ensuring that an interruption or open end of the thread is created, to which the fibers are then joined. The distance between the collecting surface 70 and the thread forming line L is therefore determined by the length of the fibers to be spun. In order to utilize the spinning device optimally for different fiber lengths, this distance is adjustable, with the pair of friction rollers or the entire housing 4 of the conveying and feeding mechanism being suspended adjustably. The adjustment means that may be required for this area are of the classic type and are therefore not shown here.

The collecting surface 70 is preferably grooved so that the fiber material needed for yarn formation is accepted in its totality and is pre-formed in width and thickness. The fibers are held fast at the bottom of groove 72, constituting the collecting surface 70 which is perforated, by means of a suction airstream. To make this possible, the disk-like cylinder 7 is connected to the suction device (not shown) via a hollow shaft 8. The suction airstream acts upon the collecting surface only within sector I however, said sector I extending, in the sense of rotation of cylinder 7, from the point of arrival of the fibers upon the collecting surface 70 to their point of transfer, predetermined by a transfer sector II. Transfer sector II is kept unaffected by the suction airstream by means of separation walls 74, so that the fibers may come loose from the collecting surface 70.

It is advantageous to assist and accelerate the loosening of the fibers from the collecting surface 70 by pneumatic means in order to ensure that all fibers reach the spinning notch 3. This is achieved by introducing an airstream into Sector II, said air stream flowing through the collecting surface 70 in direction of spinning notch 3. When the friction roller 1 is subjected to suction and housing 4 extends sealingly over friction rollers 1 and 2, this air stream is created through air being sucked from sector II. The required air is supplied by a pipe line 82, inserted in a hollow shaft 8, connecting sector II with the atmosphere. If this measure is insufficient, pipeline 82 can also be connected to a compressed air supply, providing slight overpressure to the collecting surface 70 within sector II.

In addition to the above-described means for holding the fibers on the fiber collecting surface 70 during their pneumatic conveyance, or independently thereof, the fibers can also be held on the collecting surface 70 by mechanical means, for example by needles 73 arranged on the periphery of collecting surface 70.

In order to avoid random air currents in the feeding zone in which the fibers are transferred to the collecting surface 70, and in order to expose the fibers conveyed through fiber channel 51 only to an air stream that will stretch them and ensure their oriented deposit on collecting surface 70 in the sense of said collecting surface's movement, sector III, following sector I and extending up to the outlet of fiber channel 51 is kept free of air streams by means of a fixed screen 75. In addition, seals 41 and 42 are installed at the beginning and at the end of this sector III on housing 4, said seals extending into the groove 72 and into the proximity of collecting surface 70, or touching it tangentially if said collecting surface 70 is not set with needles. Seals 41 and 42, in this instance, also act as stripping devices and exert a cleaning action upon collecting surface 70. If a collecting surface 70 set with needles is used, this function can be taken over by brushes.

The unravelling device consists of a known, rapidly rotating garniture roller covered with saw-tooth wire, tightly enclosed by a housing in the side of which an opening is provided for the separation of dirt.

For the spinning process the fiber material is conveyed over feeding trough 60 in the form of a fiber band B by means of feeding roller 6 of the unravelling roller 5, by means of which the fibers are separated into single fibers.

The negative pressure in Sector I of cylinder 7 creates a conveying air stream which carries the separated, single fibers through fiber channel 51 to the collecting surface 70 on which the fibers are deposited.

In order to obtain stretching of the fibers the surface speed of the collecting surface 70 is equal to, or somewhat greater than the speed of the fibers at the outlet of fiber channel 51, so that the fibers are subjected to acceleration at the point of their transfer to the collecting surface 70. This has as a result, however, that the fibers reach the free thread end in the spinning notch 3 at fairly high speed, causing a doubling of the entire fiber mass in the spinning notch during the twisting and joining process. It is therefore advantageous to hold the peripheral speed of the collecting surface 70 approximately equal to the speed of thread draw-off. While this does not result in any stretching when the fibers pass from fiber channel 51 to collecting surface 70, there occurs however an accumulation of the fiber mass required for the finished thread on the collecting surface 70, and thus doubling take place. The entire fiber mass needed for the finished thread is delivered from collecting surface 70 into the spinning notch. In this manner, the doubling process is separated from the spinning process.

Further improvement of yarn quality can be attained by reducing the peripheral speed of the thread collecting surface to below thread draw-off speed. In this case, doubling on the collecting surface 70 is further increased while the thus collected and doubled fiber mass is subjected to a delay and thereby to a stretching action and a parallel orientation of the fibers during their transition into the spinning notch 3 and the joining phase. The fibers fed onto the rotating collecting surface 70 while, preferably, being doubled at the same time, are conveyed by said collecting surface via sector I, on which they are held fast pneumatically and/or mechanically, to spinning notch 3 and, since collecting surface 70 moves in the notch zone in a direction parallel to the thread forming line L, they are conveyed in transfer sector II in a position parallel to the thread axis into notch 3. Theere they are joined in thread forming line L to the rotating, open thread end and are twisted into a thread or a yarn. Depending upon the design of cylinder 7, the fibers can be fed directly into the spinning notch 3 or onto the casing surface of friction roller, rotating toward notch 3, on which they are then conveyed to the thread-forming line L. The finished thread is drawn off by means of a pair of draw-off rollers 9 in the direction of rotation of the cylinder or in opposite direction.

Figure 3:
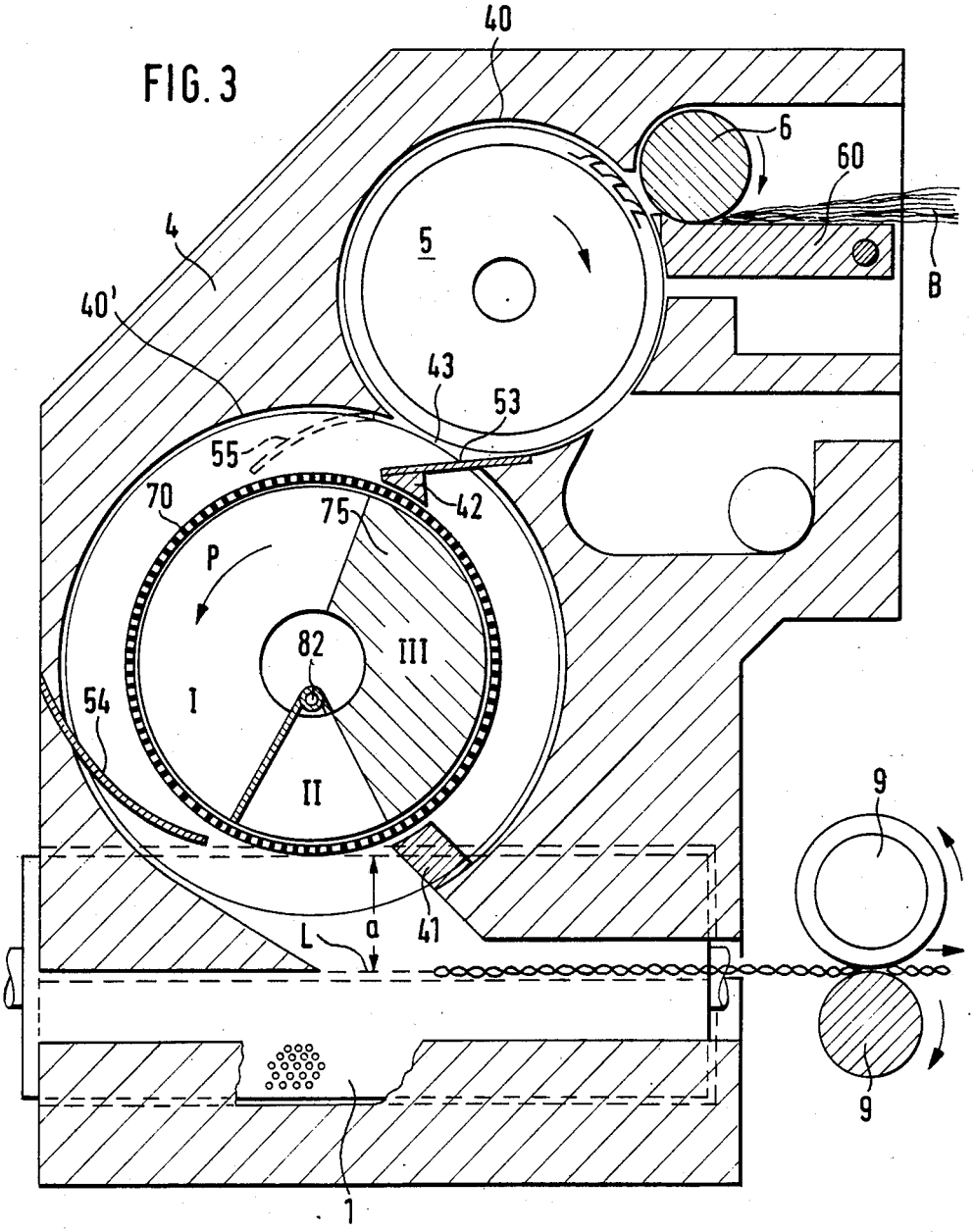
FIG. 3 shows a second embodiment of the inventive device in cross-section.
Figure 4:
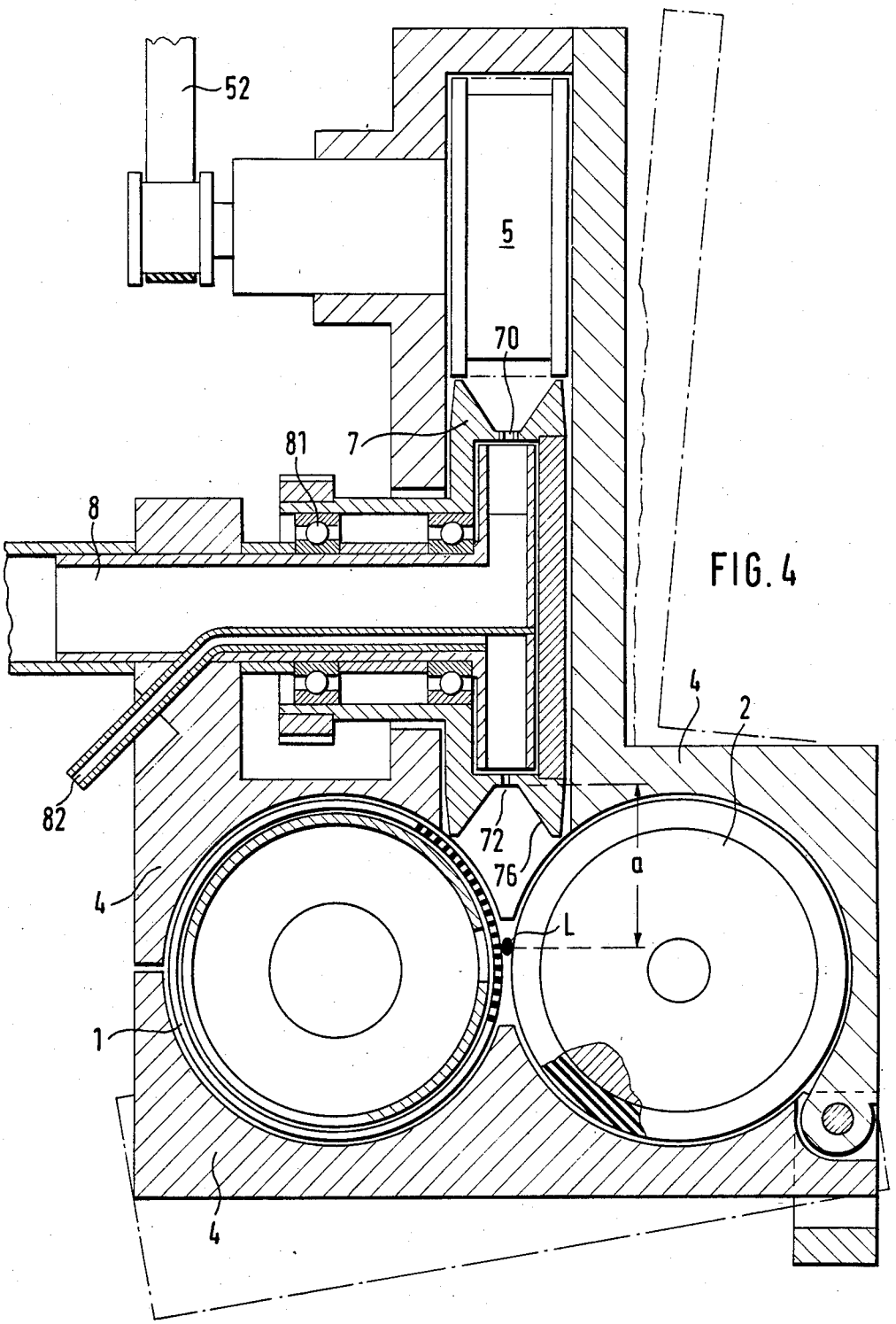
FIG. 4 shows a side view of the device of FIG. 3.

The basic difference between the embodiment shown in FIGS. 3 and 4 and that of the device shown in FIGS. 1 and 2 consists in the fact that the housing of unravelling roller 5 and the housing of cylinder 7', defined by walls 40 and 40', are immediately adjoining each other, so that the fiber channel 51 is omitted. The two housings are interconnected by a common connection opening 43 through which the fibers are transferred to the fiber collecting surface 70 by means of the unravelling roller 5, driven by belt 52. In this instance, cylinder 7' is adapted to the width of the unravelling roller 5 and is equipped with V-shaped, converging rims that bring the fibers from the width of the unravelling roller 5 down to the width of collecting surface 70. The direct transition of the fibers from the unravelling roller 5 to the collecting surface 70 eliminates all interfering influences on the way through the fiber channel. The shorter paths also require less conveying air. Cylinder 7' is subjected to air suction only sufficient to hold the fibers on collecting surface 70.

The unravelling roller 5 is equipped with a guide plate 53 attached to housing 4 and extending from the point at which the fibers detach themselves from the unravelling roller 5 to the proximity of collecting surface 70. The guiding plate 53 acts as a seal at the same time. In combination with the fixed screen 75 in sector II and, in some embodiments, in combination with an additional sealing means 42, attached to guide plate 53, it ensures that no air stream opposite to the sense of rotation of the collecting surface 70 shall seize the fibers, but that they follow the air stream in the sense of rotation of the collecting surface 70 exclusively and are deposited on said collecting surface 70 in an oriented manner. Seal 41, shown in FIG. 1 at the beginning sector II in the sense of rotation of cylinder 7 is found here too and, similarly to seal 42 attached to guide plate 53, functions simultaneously as a cleaning device. Furthermore, a screen 54 is provided between the connecting opening 43 and the transfer sector II, said screen extending to the proximity of collecting surface 70 (FIG. 3). The screen 54 prevents fibers from being seized by the suction air streaming towards friction roller 1 before being deposited on collecting surface 70. This furthermore prevents the fibers from leaving the collecting surface 70 too early and out of control, under the influence of air streaming from friction rollers 1 and 2. In order to improve fiber guidance from the unravelling device 5 to the collecting surface 70, a fiber guide plate 55 can be provided in addition, following the connecting opening 43. In all other respects, the functions of this device are identical to those of the device illustrated by FIGS. 1 and 2.

Figure 5:
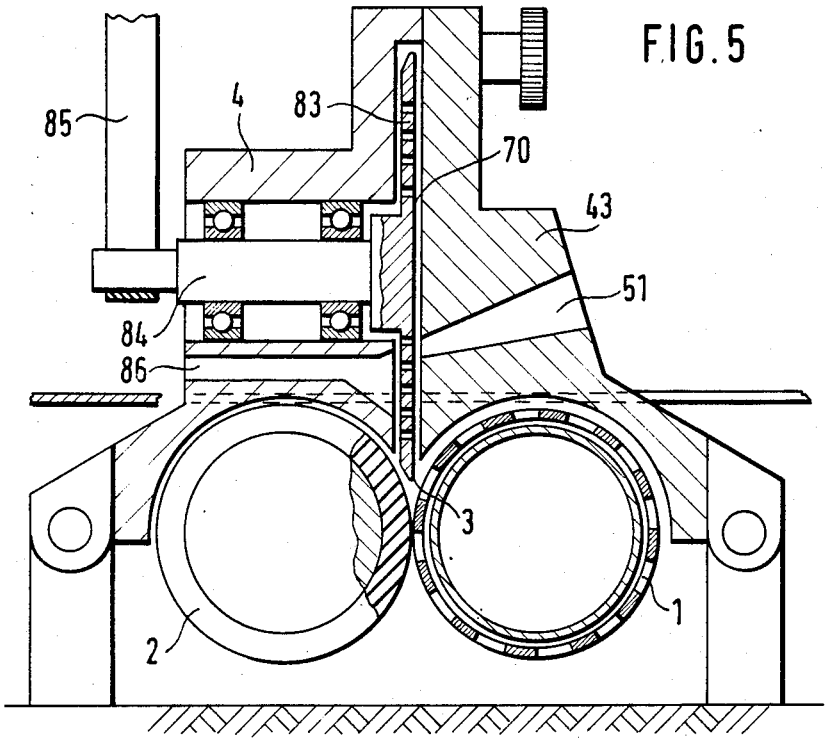
FIG. 5 is a third embodiment of the inventive device, in cross-section.
Figure 6:
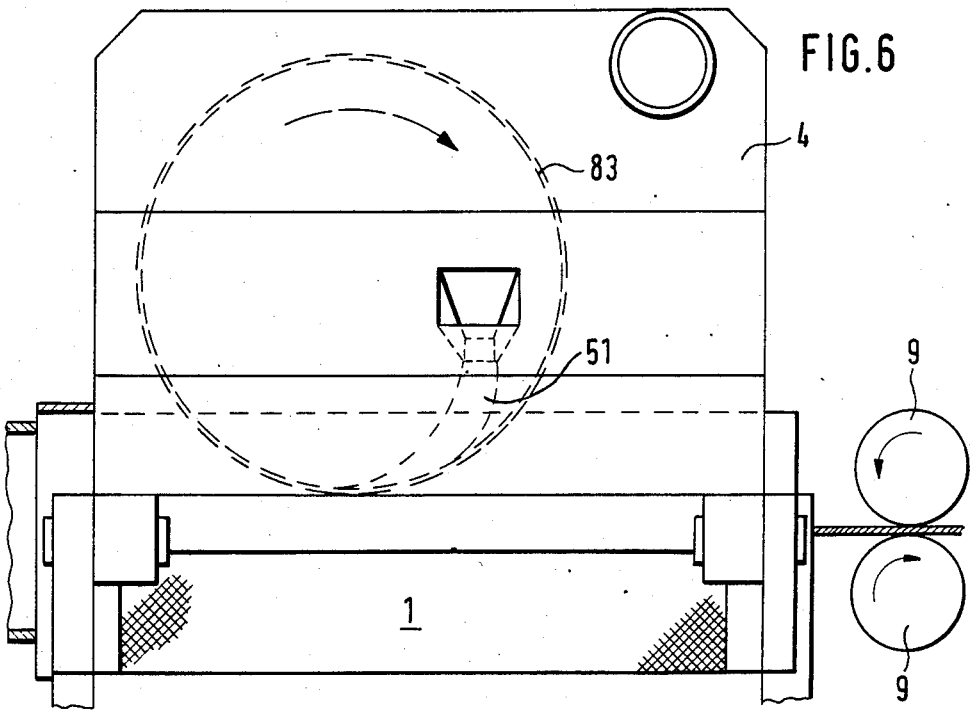
FIG. 6 shows the device of FIG. 5 in a side view.

In the embodiment of FIGS. 5 and 6, a rapidly rotating disk 83 is enclosed by a housing 4 and extends into the spinning notch 3 formed by friction rollers 1 and 2. Disk 83 is attached on a shaft 84 supported rotatably by roller bearings within housing 4, said shaft extending in a plane perpendicular to the spinning notch 3. In operation, disk 83 is driven by means of a belt 85 and moves in the notch zone parallel to the thread forming line L (FIG. 1). The disk 83 is chamfered to follow the contour of friction roller 2 so that it can extend as deeply as possible into the spinning notch 3.

The surface of disk 83 opposite to the drive constitutes collecting surface 70 against which the outlet of the fiber channel 51, located in housing 4, is directed. For ease of access, for maintenance or replacement of disk 83, the housing portion contained within fiber channel 51 is pivotably installed. Fiber channel 51 connects collecting surface 70 with the unravelling device shown in FIG. 1.

Experience has shown that fiber channel 51 should be arranged in such manner, with respect to collecting surface 70, as to cause the flying fibers to reach collecting surface 70 at an acute angle. The feeding angle can be determined in function of the type of fiber material to be spun and in function of other spinning parameters.

In order to give the fibers a better hold on the collecting surface 70, said collecting surface is provided with perforations and is subjected to negative pressure, at least in the area of fiber feeding. In order to achieve this, a suction channel 86 is provided on the side of disk 83 opposite from collecting surface 70, said suction channel being connected to a suction device (not shown). To influence the friction coefficients between collecting surface 70 and fibers, the perforated or non-perforated collecting surface can be coated and/or textured. An appropriate coating furthermore protects collecting surface 70 from wear and extends its life.

During the spinning process, the negative air pressure on the collecting surface 70 and at friction roller 1 creates a conveyig airstream in the fiber feeding channel 51, conveying the separated fibers from the unravelling device to the collecting surface 70. In this case it is advantageous if the fibers are stretched and oriented to a certain degree even before they reach the colleting surface 70. To attain this, a fiber channel is used, the inner contour of which is provided with an acceleration zone for the fibers. Such cylindrical/conical fiber channels are known to the art.

In order to avoid the crushing of fibers as they reach collecting surface 70, the RPM's of disk 83 are selected so as to cause the surface speed of the collecting surface 70, at the arrival point of the fibers, to at least equal the speed of said arriving, flying fibers.

The fibers, reaching collecting surface 70 of disk 83 at a nearly right or other, predetermined angle, are taken over by collecting surface 70 and are thereby rotated in such manner, in direction of their flight, as to cause them to reach their point of deposit in a position nearly parallel to the thread axis in the spinning notch 3. The collecting surface 70 is thus a fiber guiding surface at the same time. Within the spinning notch 3, the fibers are then tied into the free, rotating yarn end. The finished thread is drawn off by the pair of draw-off rollers 9. The thread can be pulled off in the direction of rotation of disk 3 or in the opposite direction. It is also not absolutely necessary to throw the fibers off directly into spinning notch 3. Disk 83 can be designed in such manner as to have the fibers hurled by said disk upon the casing of the suction-subjected friction roller 1, to be then conveyed on said casing into spinning notch 3.

Figure 7:
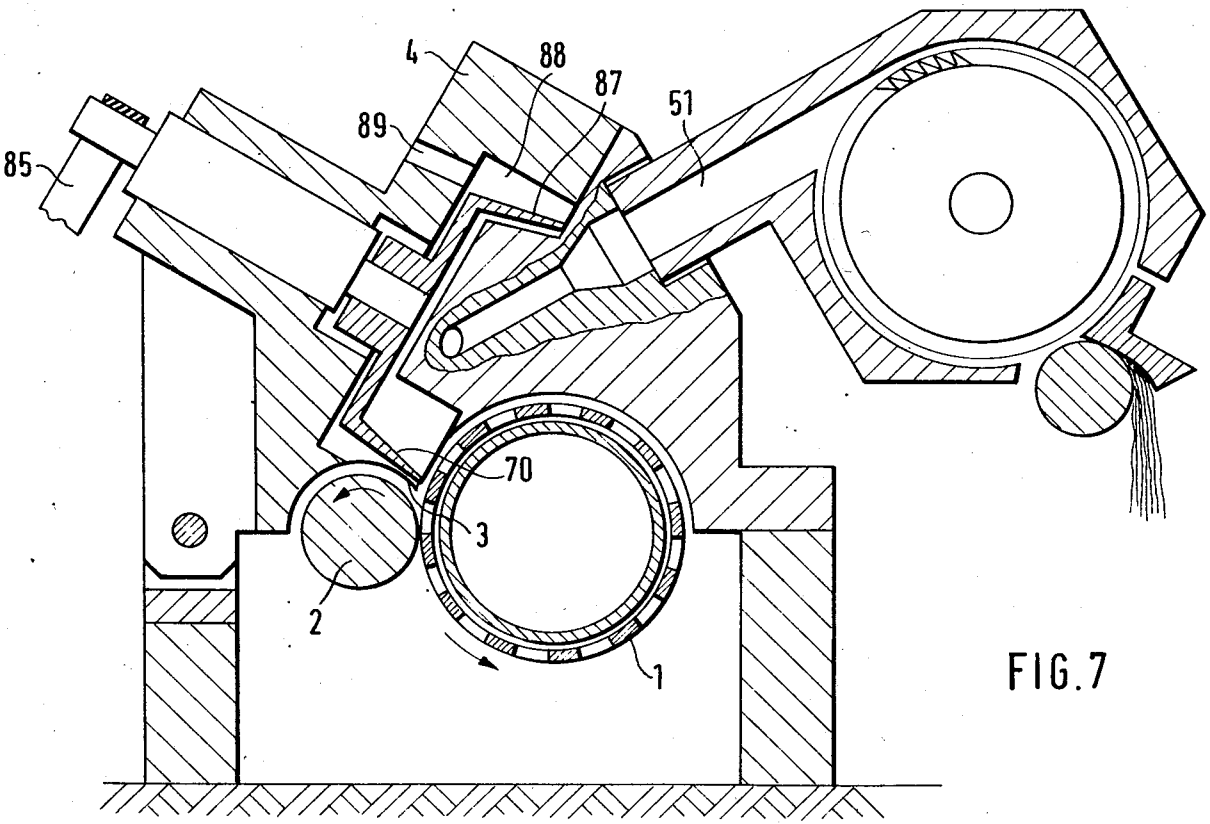
FIG. 7 shows a fourth embodiment of the inventive device, in cross-section.

The example of FIG. 7 shows a rotor 87, located inside a housing 4, said rotor being designed in the shape of an inner cone with a collecting surface 70 that is straight in its cross-section. The outlet of the fiber channel 51 is directed against said collecting surface. The rotational axis of the rotor 87, driven by a belt 85, is inclined in direction of the spinning notch and the non-perforated friction roller 3 has a diameter which is smaller than that of friction roller 1, which is subjected to suction air, so that rotor 87 can extend as far as possible into the spinning notch 3. With this design it is also possible to subject the collecting surface 70 and the fiber feeding channel 51 to negative pressure. To achieve this, chamber 88, in which rotor 87 rotates, can for example be connected to a suction device via a suction line 89 and/or a negative air pressure stream can be created across friction roller 1 within chamber 88.

Instead of a straight collecting surface 70 it would also be possible to provide one having a graded, folded or rounded contour. Such contours can achieve increased stretching of the fibers in their sliding path, such as when fibers are long or very much curled. As with disk 83 shown in FIGS. 5 and 6, the collecting surface 70 becomes at the same time a fiber guiding surface in this embodiment too.

We claim:

1. An open-end spinning device comprising an unravelling mechanism and two friction rollers in close proximity of each other, said friction rollers being driven in the same direction and forming a notch zone and a thread forming line therebetween, fibers being twistable together into a thread along said thread forming line, and furthermore including a draw-off device and a collecting surface which moves parallel to the thread forming line, the fibers being fed over said collecting surface into the notch zone.

2. A device as defined in claim 1, further comprising a disk-like cylinder, the collecting surface being located on the periphery of the disk-like cylinder, the rotational axis of which is located in a plane perpendicular to the notch zone.

3. A device as defined in claims 1 and 2, further comprising means for governing the surface speed of the collecting surface at nearly equal the thread draw-off speed.

4. A device as defined in claim 1 or 2, further comprising means for governing the surface speed of the collecting surface to be lower than the thread draw-off speed.

5. A device as defined in claims 1 or 2, further comprising means for governing the surface speed of the collecting surface to at least equal the speed at which the fibers are fed.

6. A device as defined in claim 1, wherein the collecting surface is grooved.

7. A device as defined in claim 6, further comprising a groove, the width of the groove being approximately equal to the thickness of the fiber material being fed.

8. A device as defined in claim 6, further comprising a groove, the cross-section of the groove being V-shaped.

9. A device as defined in claim 1 or 6, wherein the collecting surface is set with needles.

10. A device as defined in claim 1 or 6, wherein the collecting surface is perforated and subjected to suction.

11. A device as defined in claim 10, wherein the collecting surface is divided into different sectors to hold the fibers as they are conveyed and fed into the notch zone.

12. A device as defined in claim 11, wherein the collecting surface is subjected to such an air stream within one of the sectors so as to loosen the fibers from the collecting surface and cause the fibers to be fed into the notch zone.

13. A device as defined in claim 12, wherein one sector of the collecting surface is open to the ambient air.

14. A device as defined in claim 12, wherein one sector of the collecting surface is subjected to overpressure.

15. A device as defined in claim 1 or 6, further comprising a housing, wherein the collecting surface is enclosed in the housing.

16. A device as defined in claim 1 or 6, further comprising an unravelling device associated with the collecting surface upstream from same.

17. A device as defined in claim 16, further comprising a fiber channel, the unravelling device being connected to the collecting surface via the fiber channel which ends essentially at a tangent to the direction of the collecting surface's movement, whereby the outlet of the fiber channel is adapted to the width of the collecting surface.

18. A device as defined in claim 16, further comprising the unravelling device having a housing, and the disk-like cylinder having a housing, the housing of the unravelling device and the housing of the cylinder being located directly side by side, and a common connection opening for connecting the housing of the unravelling device with the housing of the disk-like cylinder.

19. A device as defined in claim 1 or 6, wherein the collecting surface is equipped with a cleaning device between the zone of fiber transfer which extends into the notch zone and the feed zone.

20. A device as defined in claim 1 or 6, wherein in the relative positions of the collecting surface and the thread forming line are relatively adjustable so that the distance between the collecting surface and the thread forming line is adjustable in accordance with the length of fibers to be spun together.

21. A device as defined in claim 18, further comprising a fiber guide plate connected to the connection opening, following said connection opening in the sense of movement of the fibers.

22. A device as defined in claim 1 or 6, further comprising a screen installed before the notch zone, in the sense of movement of the fibers.

23. A device as defined in claim 1, further comprising a disk and a fiber channel having an outlet, the collecting surface being located on the surface of the disk against which the outlet of the fiber channel is directed.

24. A device as defined in claim 1, further comprising a rotor, the collecting surface being located inside the rotor in the shape of an inner cone.

25. A device as defined in claim 23 or 24, wherein the collecting surface is coated.

26. A device as defined in claim 23 or 24, wherein the collecting surface is textured.

27. A device as defined in claim 23 or 24, wherein the inner profile of the fiber channel comprises an acceleration zone.

28. An open-end spinning device for use with an open-end spinning machine for spinning fibers into threads, the open-end spinning device comprising:

two friction rollers in close proximity to each other, said two friction rollers being for receiving fibers and for being driven in the same direction;

said two friction rollers defining a notch zone and a thread forming line therebetween, the fibers being twistable together into a thread along said thread forming line;

unravelling means associated with said two friction rollers for unravelling the fibers received by said two friction rollers;

a draw-off assembly associated with said two friction rollers; and a collecting surface movable parallel to said thread forming line, the fibers being feedable over said collecting surface into said notch zone.

* * * * *